United States Patent [19]

Kowaka et al.

[11] 4,201,574

[45] * May 6, 1980

[54] LOW CARBON NI-CR AUSTENITIC STEEL HAVING AN IMPROVED RESISTANCE TO STRESS CORROSION CRACKING

[75] Inventors: Masamichi Kowaka; Hisao Fujikawa, both of Amagasaki, Japan

[73] Assignee: Sumitomo Metal Industries, Ltd., Osaka, Japan

[ * ] Notice: The portion of the term of this patent subsequent to Jul. 12, 1994, has been disclaimed.

[21] Appl. No.: 879,388

[22] Filed: Feb. 21, 1978

[30] Foreign Application Priority Data

Mar. 2, 1977 [JP] Japan ..... 52-23180

[51] Int. Cl.[2] ..... C22C 38/02; C22C 38/42; C22C 38/46

[52] U.S. Cl. ..... 75/122; 75/125; 75/128 C; 75/128 V; 75/134 F

[58] Field of Search ..... 75/122, 134 F, 128 C, 75/128 W, 128 G, 128 Z, 128 T, 128 V, 125

[56] References Cited

U.S. PATENT DOCUMENTS

| | | | |
|---|---|---|---|
| 2,553,330 | 5/1951 | Post et al. | 75/122 |
| 2,873,187 | 2/1959 | Dyrkacz et al. | 75/124 |
| 3,300,347 | 1/1967 | Kasza et al. | 148/12.3 |
| 3,607,239 | 9/1971 | Mimino | 75/128 G |
| 3,926,620 | 12/1975 | Kowaka et al. | 75/122 |
| 4,035,182 | 7/1977 | Kowaka et al. | 75/122 |

FOREIGN PATENT DOCUMENTS 45-34011 10/1970 Japan .

*Primary Examiner*—Arthur J. Steiner
*Attorney, Agent, or Firm*—Fleit & Jacobson

[57] ABSTRACT

Herein disclosed is a low carbon austenitic steel having an improved resistance to stress corrosion cracking. The austenitic steel consists essentially of, by weight; less than 0.029% of carbon; 1.5 to 4.0% of silicon; 0.1 to 3.0% of manganese; 23 to 45% of nickel; 20 to 35% of chromium; 0.5 to 4.0% of vanadium; titanium in an amount of at least 5 times carbon content and up to 1% of the total composition, and/or niobium in an amount of at least 7 times carbon content and up to 1% of the total composition, and/or zirconium in an amount of at least 7 times carbon content and up to 1% of the total composition, and/or tantalum in an amount of at least 7 times carbon content and up to 2% of the total composition, and/or tungsten in an amount of at least 5 times carbon content and up to 2% of the total composition, the total amount of titanium and/or niobium and/or zirconium and/or tantalum and/or tungsten being in the range of at least 5 times carbon content and up to 2% of the total composition; if desired, copper and/or molybdenum in a total amount of 0.3 to 4%; and the balance of iron. This steel has outstanding utility as the materials of heat exchangers or pipes for generation of steam in nuclear reactors.

8 Claims, No Drawings

LOW CARBON NI-CR AUSTENITIC STEEL HAVING AN IMPROVED RESISTANCE TO STRESS CORROSION CRACKING

DETAILED DESCRIPTION OF THE INVENTION

The present invention relates to an Ni—Cr austenitic steel having an improved resistance to stress corrosion cracking. More particularly, the invention relates to an Ni—Cr austenitic steel having an improved resistance to stress corrosion cracking in water, steam or chlorine ion-containing water or steam under high temperature and high pressure conditions.

Much research has heretofore been conducted on the phenomenon and mechanism of stress corrosion cracking in Ni—Cr austenitic steels.

Stress corrosion cracking in Ni—Cr austenitic steels is liable to occur especially in chlorine ion-containing environments. As means for preventing occurrence of stress corrosion cracking, there have been adopted various measures, for example, removal of residual stress in welded or worked pieces, improvement of corrosive environments and reduction of stress corrosion cracking sensitivity by surface processing such as shot peening. As alloys having high resistance to stress corrosion cracking, there have been employed high nickel content alloys such as Inconel (trademark for an Ni-alloy having a nickel content of at least 70% by weight). However, in these nickel alloys, a rise in manufacturing cost accompanies an increase in the nickel content, and they are accordingly not preferred from the economical viewpoint.

In recent years, demand for stainless steels exhibiting excellent resistance to stress corrosion cracking has increased with the development of the nuclear and chemical industries. Preventing stress corrosion cracking in water or steam of high temperature and high pressures is a serious problem, especially in the nuclear industry.

A boiling $MgCl_2$ solution has heretofore been generally used as a test solution in laboratory experiments for testing stress corrosion cracking in Ni—Cr austenitic steels, and most alloys heretofore developed as materials having an improved resistance to stress corrosion cracking have been evaluated based on results obtained in tests using this test solution. However, data obtained in the experiments using this $MgCl_2$ test solution do not faithfully indicate the resistance to actual stress corrosion cracking. In other words, the test using this test solution does not faithfully reproduce the actual application environment where a steel material practically suffers from stress corrosion cracking, and the actual state of cracking is different from the cracking state simulated in this test. For example, in a boiling $MgCl_2$ solution, the type of stress corrosion cracking observed is mainly transgranular cracking, but in an actual environment, as in high-temperature and high-pressure water or steam or in an environment very close to this actual environment, not only transgranular cracking but also intergranular cracking takes place to a remarkable extent. Inconel does not undergo stress corrosion cracking in a boiling $MgCl_2$ solution, but this alloy readily suffers from stress corrosion cracking in high-temperature and high-pressure water or steam. The intergranular stress corrosion cracking differs from the so-called intergranular corrosion with respect to the mechanism, and by the term "intergranular stress corrosion cracking" is meant intergranular cracking which occurs in a case where stress is present.

Accordingly, results of the stress corrosion cracking tests conducted in boiling $MgCl_2$ solutions cannot be appropriate data for evaluating the resistance to stress corrosion cracking in high-temperature and high-pressure water or steam.

In general, stress corrosion cracking advances according to the following mechanism.

Steel material is rendered passive in a water-containing specific environment, and when a tensile stress is imposed on the material in this passive state, repair of the film of the passive state becomes impossible locally at a part where this film is broken, owing to a reduction in the pH of the corrosive medium or the like factor. As a result, corrosion advances from this part where repair is impossible, and cracking finally results.

Accordingly, the mechanism of stress corrosion cracking is quite different from the mechanism of crevice corrosion or pitting corrosion.

In case of pitting corrosion, when the material is rendered passive and a substance adheres to the surface of the material, an electric cell of varied oxygen concentration is formed between a crevice defined between the adhering substance and the material, and the surrounding portion, and corrosion advances locally in the portion where the electric concentration cell is formed. Accordingly, the pitting corrosion is different from the stress corrosion cracking with respect to the phenomenon and mechanism. Therefore, elements for improving the resistance to pitting corrosion should naturally differ from elements for improving the resistance to stress corrosion cracking. In other words, it cannot be said that elements effective for one improvement would also be effective for the other improvement.

Japanese Patent Publication No. 34011/70 (Kowaka et al.) discloses a pitting corrosion-resistant stainless steel comprising 1.5 to 4% by weight of Si and 2 to 5% by weight of V as well as 8 to 33% by weight of Ni and 16 to 30% by weight of Cr. This Patent Publication, however, gives no teaching about the resistance to stress corrosion cracking. Especially, the Patent Publication does not teach at all that the resistance to stress corrosion cracking can be improved by controlling the carbon content to a very low level and adding elements capable of fixing C, such as Ti and Nb.

An austenitic steel comprising 7.0 to 22% by weight of Ni, 15.0 to 26.0% by weight of Cr, 0.05 to 2.5% by weight of V and Nb and Ta in a total amount of 0.001 to 0.30% by weight is disclosed in the specification of U.S. Pat. No. 3,607,239 (Mimino et al.). This steel is a heat-resistant steel in which a high creep strength at high temperatures is a most characteristic property, and in order to maintain the necessary strength, C must be incorporated in an amount of 0.03 to 0.30% by weight as an indispensable element.

Other Cr-Ni heat-resistant steels for parts or work pieces required to have a high strength at high temperature are disclosed in the specification of U.S. Pat. No. 2,873,187 (Dyrkacz et al.) and the specification of U.S. Pat. No. 3,300,347 (Kasza et al.). In each prior art reference, there is disclosed 10 to 20% or 5 to 22% by weight of Cr respectively, however, they do not teach that the steel is excellent in resistance to stress corrosion cracking.

We previously proposed austenitic steels having an excellent resistance to stress corrosion cracking, especially at tests not using the above-mentioned $MgCl_2$ solution, in the specifications of U.S. Pat. No. 3,926,620 and U.S. Pat. No. 4,035,182. One of characteristic features of the steel disclosed in the former specification is that the carbon content is controlled to less than 0.03% by weight and Si and V are incorporated, and one of characteristic features of the steel disclosed in the latter specification is that carbon is incorporated in an amount of 0.03 to 0.12% by weight and at least one element selected from Ti, Nb, Zr and W is incorporated together with Si and V. These steels have an excellent resistance to stress corrosion cracking in high-temperature and high-pressure water containing chlorine ions, but in these steels, further improvements of properties so that they can be used for a long time have been desired.

With such background, the following are objects of the present invention.

(1) To obtain an alloy having an excellent resistance to stress corrosion cracking under test conditions equivalent to conditions where the alloy is actually employed.

(2) To obtain an alloy having an excellent resistance to stress corrosion cracking when the alloy is used in high-temperature and high-pressure water or steam for a long time.

(3) To obtain an alloy having such excellent resistance to stress corrosion cracking as mentioned above in which contents of expensive elements, especially the Ni content, are reduced to relatively low levels.

(4) To further improve properties of steels proposed in the specifications of the above-mentioned U.S. Pat. Nos. 3,926,620 and 4,035,182.

We have found that the foregoing objects can be attained by an austenitic steel consisting essentially of less than 0.029% by weight of C, 1.5 to 4.0% by weight of Si, 0.1 to 3.0% by weight of Mn, 23 to 45% by weight of Ni, 20 to 35% by weight of Cr, 0.5 to 4.0% by weight of V and at least one member selected from the group consisting of Ti in an amount of at least 5 times the carbon content and up to 1% by weight, Nb in an amount of at least 7 times the carbon content and up to 1% by weight, Zr in an amount of at least 7 times the carbon content and up to 1% by weight, Ta in an amount of at least 7 times the carbon content and up to 2% by weight and W in an amount of at least 5 times the carbon content and up to 2% by weight, the total amount of any combination of Ti, Nb, Zr, Ta and W being in the range of at least 5 times the carbon content and up to 2% by weight of the total composition, with the balance being essentially Fe.

Among austenitic steels having the above composition, from the viewpoint of the balance of the manufacturing cost with steel properties such as the resistance to stress corrosion cracking, the workability and the weldability, an austenitic steel consisting essentially of less than 0.020% by weight of C, 1.5 to 2.5% by weight of Si, 0.5 to 2.0% by weight of Mn, 23 to 35% by weight of Ni, 23 to 30% by weight of Cr, 0.5 to 2% by weight of V and at least one element selected from the group consisting of Ti in an amount of at least 10 times the carbon content and up to 0.5% by weight, Nb in an amount of at least 10 times the carbon content and 0.5% by weight, Zr in an amount of at least 10 times the carbon content and up to 0.5% by weight, Ta in an amount of at least 10 times the carbon content and up to 1% by weight and W in an amount of at least 10 times the carbon content and up to 1% by weight, the total amount of any combination of Ti, Nb, Zr, Ta and W being in the range of at least 10 times the carbon content and up to 1% by weight of the total composition, with the balance being essentially Fe, is especially preferred.

In order to improve the resistance to general corrosion and pitting corrosion in an acidic environment or chlorine ion-containing environment as well as the resistance to stress corrosion cracking, it is preferred that at least one element selected from the group consisting of 0.3 to 4% by weight of Cu and 0.3 to 4% by weight of Mo be further incorporated with the proviso that the total amount of Cu and Mo is 0.3 to 4% by weight of the total composition.

In the steel of the present invention, the general corrosion resistance and the resistance to stress corrosion cracking can be remarkably enhanced by the generic synergistic effect of all the ingredients including Ni and Cr. The steel of the present invention is most characterized in that the carbon content is controlled to less than 0.029% by weight, V is incorporated in an amount of 0.5 to 4.0% by weight and at least one element selected from the group consisting of Ti, Nb, Zr, Ta and W is incorporated in a specific amount.

As a result of experiments made by us, it was confirmed that C is an element enhancing remarkably the sensitivity to stress corrosion cracking in the above-mentioned atmosphere and that good results can be obtained when the carbon content is controlled to a level as low as possible and a predetermined amount of an element capable of fixing C and rendering C harmless, which is selected from Ti, Zr, Nb, Ta and W, is incorporated. Further, it was confirmed that when V is co-present with Si, the resistance to stress corrosion cracking can be remarkably improved by the synergistic effect of both the elements.

Si is known to be an element enhancing the resistance to stress corrosion cracking, and it is said that the effect of Si is due to the fact that when a passive film formed on the surface of an austenitic steel is destroyed by an aggressive ion such as $Cl^-$, Si prevents corrosion from advancing in the thickness direction of the steel. However, this effect of Si can be expected only against stress corrosion cracking of the transgranular cracking type, and Si alone has no substantial effect against stress corrosion cracking of the intergranular cracking type.

Accordingly, in case of steels which are used in an atmosphere causing stress corrosion resulting in occurrence of intergranular cracking, such as in high-temperature and high-pressure water or steam, by incorporation of Si alone it is impossible to prevent completely occurrence of stress corrosion cracking.

We have confirmed that if 1.5 to 4.0% by weight of Si and 0.5 to 4.0% by weight of V are simultaneously included, it is possible to provide an austenitic steel having a high resistance to stress corrosion cracking of either the transgranular cracking type or the intergranular cracking type.

The reasons for the above restrictions on the contents of the respective ingredients will now be described.

As will be apparent from the results of an Example given hereinafter, C enhances the sensitivity to stress corrosion cracking in pure water or chlorine ion-containing high-temperature and high-pressure water or steam. Further, when the steel is welded for actual application, there is a risk that carbon is sensitized to precipitate a carbide of the $M_{23}C_6$ type causing stress corrosion cracking of the intergranular cracking type. Accordingly, the carbon content is limited to less than 0.029% by weight. Of course, it is preferred to control the carbon content to a level as low as technically possible.

When the V content is lower than 0.5% by weight, no substantial contribution is made to the improvement of the resistance to stress corrosion cracking by addition of V. In contrast, when the V content exceeds 4% by weight, the workability of the steel is degraded.

If the Si content is lower than 1.5% by weight, no substantial effect of improving the resistance to stress corrosion cracking is attained even in the presence of V. On the other hand, when the Si content exceeds 4% by weight, both the workability and the weldability are degraded.

When the Ni content is lower than 23% by weight, no good balance is obtained between the Ni content and Cr content and the austenite structure becomes unstable. Accordingly, there is a risk of degradation of the corrosion resistance, the high temperature strength and other properties. When the Ni content exceeds 35% by weight, the resistance to stress corrosion cracking is sufficient but the resulting steel is very expensive.

Cr is an element most effective for improving the corrosion resistance. If the Cr content is lower than 20% by weight, the corrosion resistance is degraded, and if the Cr content exceeds 35% by weight, the workability becomes poor.

From the viewpoints of the cost of the steel and the balance between corrosion resistance and workability, it is preferred that the Ni and Cr contents be 23 to 35% by weight and 23 to 30% by weight, respectively.

Incidentally, if the Cr content is close to the upper limit, in order to obtain a stable austenite structure, the Ni content is increased in the above-mentioned range.

When the Mn content is lower than 0.1% by weight, the resulting steel is insufficient in the hot workability and deoxidizing property. In contrast, if the Mn content exceeds 3% by weight, problems arise with respect to manufacture and working of the steel.

As pointed out hereinbefore, a high effect of improving the resistance to stress corrosion cracking can be attained by controlling the C content to a level as low as possible. However, incorporation of a minute amount of carbon cannot be avoided owing to difficulties in the steel-manufacturing process or from the viewpoint of the manufacturing cost. Even if the amount of residual carbon is very minute, residual carbon is sensitized at the welding step to form a carbide of the $M_{23}C_6$ type or when the steel is used at high temperature for a long time, formation of the carbide of this type is enhanced. When the carbide of this type is formed, there is a risk of occurrence of stress corrosion cracking of intergranular cracking type. In order to avoid this risk, at least one element selected from Ti, Nb, Zr, Ta and W is incorporated to fix C and render it harmless. The contents of these elements are as follows:

Ti: at least 5 times the C content and up to 1% by weight

Nb: at least 7 times the C content and up to 1% by weight

Zr: at least 7 times the C content and up to 1% by weight

Ta: at least 7 times the C content and up to 2% by weight

W: at least 5 times the C content and up to 2% by weight.

When two or more of the foregoing elements are incorporated in combination, the total content is adjusted in the range of at least 5 times the C content and up to 2% by weight. In case of each element, if the content is lower than the lower limit, no substantial effect can be attained, and if the content is higher than the upper limit, an intermetallic compound is formed and the resistance to stress corrosion cracking is rather degraded. Most preferred contents of these additive elements are as follows:

Ti: at least 10 times the C content and up to 0.5% by weight

Nb: at least 10 times the C content and up to 0.5% by weight

Zr: at least 10 times the C content and up to 0.5% by weight

Ta: at least 10 times the C content and up to 1% by weight

W: at least 10 times the C content and up to 1% by weight.

The preferred total content of these elements is in the range of at least 10 times the C content and up to 1% by weight.

In the steel of the present invention, the resistance to stresss corrosion cracking can be remarkably enhanced by the above-mentioned specific composition, and the steel is comparable to conventional austenitic stainless steels with respect to ordinary corrosion resistances, such as the resistance to pitting corrosion and the resistance to general corrosion. When the steel is used in a highly corrosive environment, for example, in an acidic environment, and not only high resistance to stress corrosion cracking but also high general corrosion resistance and high pitting corrosion resistance are required, it is preferred to further incorporate at least one element selected from Mo and Cu capable of forming a stable passive film.

In this case, if the content of Mo is lower than 0.3% by weight, no substantial effect of improving the corrosion resistance can be attained, and if the Mo content exceeds 4% by weight, the resistance to stress corrosion cracking is degraded.

Cu as well as Mo is incorporated so as to improve the corrosion resistance. If the Cu content is lower than 0.3% by weight, no substantial effect of improving the corrosion resistance can be attained by addition of Cu, and if the Cu content exceeds 4% by weight, the resistance to stress corrosion cracking is degraded.

When Mo and Cu are incorporated in combination, from the viewpoint of the resistance to stress corrosion cracking, it is preferred that the total amount of Mo and Cu be in the range of 0.3 to 4% by weight.

The balance of the steel of the present invention is essentially Fe. However, accompanying impurities are further contained in the steel of the present invention in addition to the above-mentioned ingredients and Fe. In general, lower contents of these impurities are more preferred. Among these impurities, especially P enhances the sensitivity of the steel to stress corrosion cracking. Accordingly, it is preferred to control the P content below 0.020% by weight.

The present invention will now be described in detail by reference to the following Example that by no means limits the scope of the invention.

EXAMPLE 1

In Table 1, there are shown compositions of steels used for the tests, namely steels of the present invention (Nos. 1 to 13), comparative steels (Nos. 14 to 19) and commercially available alloys, i.e., Inconel 600 (No. 20), Incoloy 800 (No. 21), AISI 304 (No. 22), AISI 316 (No. 23), AISI 321 (No. 24) and AISI 347 (No. 25).

In case of steels Nos. 1 to 19, ingots were prepared by melting and were formed into plates having a thickness of 3 mm, and specimens having a width of 10 mm, a length of 75 mm and a thickness of 2 mm were prepared from these plates. Similar specimens were cut from commercially available pipes of steels Nos. 20 to 25. These specimens were subjected to the solution treatment. Another set of specimens of all the steels were subjected to the above-mentioned solution treatment and were then subjected to the sensitization treatment (each specimen was heated at 677° C. for 5 hours and then air-cooled). These treated specimens were bent in a double U shape by using a mandrel having a radius of 7.5 mm, and they were placed in either of the following two test environments under stress.

(1) High-temperature and high-pressure water at 300° C. which contained 500 ppm of chlorine ion (added as NaCl) and had been saturated with dissolved oxygen (at room temperature) . . . liquid phase (2) High-temperature and high-pressure steam at 300° C. which contained 500 ppm of chlorine ion and had been saturated with dissolved oxygen (at room temperature) . . . vapor phase The solution was replaced with a fresh solution at intervals of every 100 hours, and if cracking was not observed, the test was continued for 2000 hours. Obtained results are shown in Table 2.

Table 1

| | Steel No. | Composition (% by weight) | | | | | | | | | | | | | |
|---|---|---|---|---|---|---|---|---|---|---|---|---|---|---|---|
| | | C | Si | Mn | P | Cu | Ni | Cr | Mo | V | Ti | Nb | Zr | Ta | W |
| Steels of Present Invention | 1 | 0.008 | 1.65 | 1.68 | 0.010 | <0.01 | 25.51 | 24.92 | <0.01 | 0.83 | 0.35 | | | | |
| | 2 | 0.012 | 1.58 | 1.59 | 0.008 | <0.01 | 27.42 | 25.51 | <0.01 | 1.36 | | 0.41 | | | |
| | 3 | 0.005 | 1.71 | 1.45 | 0.015 | <0.01 | 26.48 | 25.72 | <0.01 | 2.21 | | 0.25 | | | 0.72 |
| | 4 | 0.015 | 1.84 | 1.38 | 0.012 | <0.01 | 28.32 | 24.41 | <0.01 | 2.54 | 0.18 | | | | 1.05 |
| | 5 | 0.009 | 2.05 | 1.61 | 0.018 | <0.01 | 35.18 | 25.91 | <0.01 | 2.92 | | 0.48 | | | |
| | 6 | 0.011 | 2.23 | 1.49 | 0.009 | <0.01 | 35.06 | 20.84 | <0.01 | 3.38 | 0.38 | | | | |
| | 7 | 0.020 | 1.78 | 1.35 | 0.003 | <0.01 | 41.22 | 20.62 | <0.01 | 0.65 | | 0.66 | | | |
| | 8 | 0.010 | 2.46 | 1.24 | 0.012 | <0.01 | 24.54 | 26.21 | <0.01 | 1.82 | | | 0.35 | 0.66 | |
| | 9 | 0.018 | 2.89 | 1.16 | 0.014 | <0.01 | 29.02 | 20.34 | <0.01 | 1.56 | | 0.32 | | 0.81 | |
| | 10 | 0.009 | 1.91 | 1.82 | 0.012 | <0.01 | 27.17 | 26.46 | <0.01 | 1.33 | 0.31 | | | | |
| | 11 | 0.005 | 3.50 | 0.55 | 0.010 | <0.01 | 44.25 | 33.25 | <0.01 | 0.31 | | | 0.38 | | |
| | 12 | 0.024 | 2.01 | 1.07 | 0.015 | <0.01 | 35.81 | 27.24 | 2.23 | 2.28 | | 0.36 | | | |
| | 13 | 0.027 | 1.85 | 1.95 | 0.011 | 2.05 | 32.06 | 29.54 | <0.01 | 1.46 | 0.36 | | | | |
| Comparative Steels | 14 | 0.018 | 2.54 | 1.66 | 0.012 | <0.01 | 25.06 | 20.62 | <0.01 | 1.12 | 0.05 | | | | |
| | 15 | 0.024 | 1.52 | 1.69 | 0.015 | <0.01 | 26.23 | 24.12 | <0.01 | 1.54 | | 0.13 | | | |
| | 16 | 0.028 | 1.82 | 1.13 | 0.008 | <0.01 | 30.28 | 23.98 | <0.01 | 0.80 | 0.09 | | | | |
| | 17 | 0.005 | 1.59 | 1.58 | 0.013 | <0.01 | 25.91 | 22.56 | <0.01 | <0.01 | 0.33 | | | | |
| | 18 | 0.06 | 2.23 | 1.15 | 0.010 | <0.01 | 27.64 | 25.01 | <0.01 | 1.01 | 0.21 | | | | |
| | 19 | 0.008 | 1.94 | 1.28 | 0.019 | <0.01 | 26.33 | 25.31 | <0.01 | 0.95 | | 1.56 | | | |
| Inconel | 20 | 0.03 | 0.28 | 0.19 | 0.005 | 0.01 | 75.24 | 15.63 | 0.01 | <0.01 | | | | | |
| Incoloy | 21 | 0.05 | 0.62 | 1.22 | 0.023 | 0.06 | 33.05 | 21.12 | 0.01 | <0.01 | | | | | |
| AISO 304 | 22 | 0.06 | 0.65 | 1.78 | 0.025 | 0.027 | 9.25 | 18.65 | 0.06 | | | | | | |
| AISI 316 | 23 | 0.06 | 0.54 | 1.66 | 0.023 | 0.23 | 13.30 | 16.50 | 2.14 | | | | | | |
| AISI 321 | 24 | 0.06 | 0.60 | 1.75 | 0.022 | 0.007 | 11.10 | 17.50 | 0.06 | | 0.44 | | | | |
| AISI 347 | 25 | 0.05 | 0.66 | 1.69 | 0.024 | 0.027 | 11.70 | 17.60 | 0.07 | | | 0.71 | | | |

Table 2

| | | Test Results | | | | | | | |
|---|---|---|---|---|---|---|---|---|---|
| | | Time (hours) to Cracking | | | | | | | |
| | | Liquid Phase | | | | Vapor Phase | | | |
| | Steel No. | Solution Treatment | | Sensitization Treatment | | Solution Treatment | | Sensitization Treatment | |
| Steels of Present Invention | 1 | NC* | NC | NC | NC | NC | NC | NC | NC |
| | 2 | " | " | " | " | " | " | " | " |
| | 3 | " | " | " | " | " | " | " | " |
| | 4 | " | " | " | " | " | " | " | " |
| | 5 | " | " | " | " | " | " | " | " |
| | 6 | " | " | " | " | " | " | " | " |
| | 7 | " | " | " | " | " | " | " | " |
| | 8 | " | " | " | " | " | " | " | " |
| | 9 | " | " | " | " | " | " | " | " |
| | 10 | " | " | " | " | " | " | " | " |
| | 11 | " | " | " | " | " | " | " | " |
| | 12 | " | " | " | " | " | " | " | " |
| | 13 | " | " | " | " | " | " | " | " |
| Comparative Steels | 14 | 1600 | 1400 | 1100 | 1100 | 1500 | 1500 | 1100 | 1100 |
| | 15 | 1400 | 1200 | 1100 | 1200 | 1400 | 1400 | 1100 | 1100 |
| | 16 | 1300 | 1100 | 1100 | 1100 | 1200 | 1100 | 1100 | 1200 |
| | 17 | 1200 | 1100 | 1200 | 1100 | 1100 | 1200 | 1200 | 1200 |
| | 18 | 400 | 200 | 200 | 200 | 400 | 400 | 200 | 100 |
| | 19 | 700 | 900 | 800 | 1000 | 800 | 800 | 1100 | 600 |
| Inconel | 20 | 1000 | 1000 | 300 | 500 | 1000 | 1000 | 500 | 500 |
| Incoloy | 21 | 500 | 400 | 200 | 200 | 500 | 300 | 200 | 200 |
| AISI 304 | 22 | 100 | 100 | 100 | 100 | 100 | 200 | 100 | 100 |
| AISI 316 | 23 | 200 | 200 | 100 | 100 | 100 | 100 | 100 | 100 |
| AISI 321 | 24 | 100 | 100 | 100 | 100 | 100 | 100 | 100 | 100 |

Table 2-continued

| | Steel No. | Test Results: Time (hours) to Cracking | | | | | | | |
|---|---|---|---|---|---|---|---|---|---|
| | | Liquid Phase | | | | Vapor Phase | | | |
| | | Solution Treatment | | Sensitization Treatment | | Solution Treatment | | Sensitization Treatment | |
| AISI 347 | 25 | 100 | 200 | 100 | 100 | 100 | 200 | 100 | 100 |

Note:
NC: cracking was not caused at 2000 hours' test

As will be apparent from the results shown in Table 2, the steels of the present invention did not show cracking at all in 2000 hours' tests in either the liquid phase or the vapor phase, whether they were subjected to the solution treatment alone or to both the solution treatment and the sensitization treatment. On the other hand, in each of the comparative steels and commercially available steels, cracking was caused before the tests were continued for 2000 hours. Especially in the case of the commercially available austenitic steels, cracking was caused in an extremely short time. Even in the case of Inconel 600, which is ordinarily regarded as having a high resistance to stress corrosion cracking, in the above-mentioned test environments, cracking was caused before the tests were continued for 1000 hours. Accordingly, it will readily be understood that Inconel 600 is much inferior to the steels of the present invention with respect to the resistance to stress corrosion cracking when used in high-temperature and high-pressure water or steam.

As will be apparent from the results shown in Table 2, steels Nos. 12 and 13 containing Mo or Cu were comparable to other steels of the present invention with respect to the resistance to stress corrosion cracking. It was further found that these steels were much superior to other steels of the present invention with respect to the ordinary corrosion resistance in high-temperature and high-pressure water. Results of this test are shown in Table 3.

Table 3

| Steel No. | Corrosion Loss* ($mg/cm^2$) |
|---|---|
| 1 | 0.27 |
| 5 | 0.21 |
| 12 | 0.10 |
| 13 | 0.15 |
| 20 | 1.10 |
| 23 | 0.46 |

*experimental conditions were the same as those adopted for the liquid phase test described in Table 2; plate-like specimens width of 10 mm, length of 40 mm and thickness of 2 mm were dipped in the test medium for 1000 hours As will be apparent from the foregoing illustration, steels of the present invention are superior over not only ordinary austenitic stainless steels but also over expensive Ni-base alloys, especially with respect to the resistance to stress corrosion cracking in high-temperature and high-pressure water or steam. Accordingly, the steels of the present invention are most preferred materials for heat exchangers and pipes for generation of steam in nuclear reactors.

What is claimed is

1. A low carbon Ni—Cr austenitic steel having an improved resistance to stress corrosion cracking, which consists essentially of less than 0.029% by weight of carbon, 1.5 to 4.0% by weight of silicon, 0.1 to 3.0% by weight of manganese, 23 to 45% by weight of nickel, 20 to 35% by weight of chromium, 0.5 to 4.0% by weight of vanadium, and at least one element selected from the group consisting of titanium in an amount of at least 5 times the carbon content and up to 1% by weight of the total composition, niobium in an amount of at least 7 times the carbon content and up to 1% by weight of the total composition, zirconium in an amount of at least 7 times the carbon content and up to 1% by weight of the total composition, tantalum in an amount of at least 7 times the carbon content and up to 2% by weight of the total composition and tungsten in an amount of at least 5 times the carbon content and up to 2% by weight of the total composition, the total amount of any combination of the group consisting of titanium, niobium, zirconium, tantalum and tungsten being in the range of at least 5 times the carbon content and up to 2% by weight of the total composition, with the balance being essentially iron.

2. The composition of claim 1 further characterized in that the impurity phosphorus, if present, is below 0.020% by weight of the total composition.

3. A low carbon Ni—Cr austenitic steel having an improved resistance to stress corrosion cracking, which consists essentially of less than 0.029% by weight of carbon, 1.5 to 4.0% by weight of silicon, 0.1 to 3.0% by weight of mangenese, 23 to 45% by weight of nickel, 20 to 35% by weight of chromium, 0.5 to 4.0% by weight of vanadium, at least one element selected from the group consisting of titanium in an amount of at least 5 times the carbon content and up to 1% by weight of the total composition, niobium in an amount of at least 7 times the carbon content and up to 1% by weight of the total composition, zirconium in an amount of at least 7 times the carbon content and up to 1% by weight of the total composition, tantalum in an amount of at least 7 times the carbon content and up to 2% by weight of the total composition and tungsten in an amount of at least 5 times the carbon content and up to 2% by weight of the total composition, the total amount of any combination of the group consisting of titanium, niobium, zirconium, tantalum and tungsten being in the range of at least 5 times the carbon content and up to 2% by weight of the total composition, and at least one element selected from the group consisting of 0.3 to 4% by weight of copper and 0.3 to 4% by weight of molybdenum, the total amount of copper and molybdenum being in the range of 0.3 to 4% by weight, with the balance being essentially iron.

4. The composition of claim 3 further characterized in that the impurity phosphorus, if present, is below 0.020% by weight of the total composition.

5. A low carbon Ni—Cr austenitic steel having an improved resistance to stress corrosion cracking, which consists essentially of less than 0.020% by weight of carbon, 1.5 to 2.5% by weight of silicon, 0.5 to 2.0% by weight of manganese, 23 to 35% by weight of nickel, 23 to 30% by weight of chromium, 0.5 to 2.0% by weight of vanadium, and at least one element selected from the group consisting of titanium in an amount of at least 10 times the carbon content and up to 0.5% by weight of the total composition, niobium in an amount of at least 10 times the carbon content and up to 0.5% by weight of the total composition, zirconium in an amount of at least 10 times the carbon content and up to 0.5% by weight of the total composition, tantalum in an amount of at least 10 times the carbon content and up to 1% by weight of the total composition and tungsten in an mount of at least 10 times the carbon content and up to 1% by weight of the total composition, the total amount of any combination of the group consisting of titanium, niobium, zirconium, tantalum and tungsten being in the range of at least 10 times the carbon content and up to 1% by weight of the total composition, with the balance being essentially iron.

6. The composition of claim 5 further characterized in that the impurity phosphorus, if present, is below 0.020% by weight of the total composition.

7. A low carbon Ni—Cr austenitic steel having an improved resistance to stress corrosion cracking, which consists essentially of less than 0.020% by weight of carbon, 1.5 to 2.5% by weight of silicon, 0.5 to 2.0% by weight of manganese, 23 to 35% by weight of nickel, 23 to 30% by weight of chromium, 0.5 to 2.0% by weight of vanadium, at least one element selected from the group consisting of titanium in an amount of at least 10 times the carbon content and up to 0.5% by weight of the total composition, niobium in an amount of at least 10 times the carbon content and up to 0.5% by weight of the total composition, zirconium in an amount of at least 10 times the carbon content and up to 0.5% by weight of the total composition, tantalum in an amount of at least 10 times the carbon content and up to 1% by weight of the total composition and tungsten in an amount of at least 10 times the carbon content and up to 1% by weight of the total composition, the total amount of any combination of the group consisting of titanium, niobium, zirconium, tantalum and tungsten being in the range of at least 10 times the carbon content and up to 1% by weight of the total composition, and at least one element selected from the group consisting of 0.3 to 4% by weight of copper and 0.3 to 4% by weight of molybdenum, the total amount of copper and molybdenum being in the range of 0.3 to 4% by weight, with the balance being essentially iron.

8. The composition of claim 7 further characterized in that the impurity phosphorus, if present, is below 0.020% by weight of the total composition.

* * * * *